US007670209B2

(12) United States Patent
Fujita

(10) Patent No.: US 7,670,209 B2
(45) Date of Patent: Mar. 2, 2010

(54) PAD CONDITIONER, PAD CONDITIONING METHOD, AND POLISHING APPARATUS

(75) Inventor: Takashi Fujita, Mitaka (JP)

(73) Assignee: Tokyo Seimitsu Co., Ltd., Tokyo (JP)

( * ) Notice: Subject to any disclaimer, the term of this patent is extended or adjusted under 35 U.S.C. 154(b) by 0 days.

(21) Appl. No.: 11/463,209

(22) Filed: Aug. 8, 2006

(65) Prior Publication Data

US 2007/0077870 A1 Apr. 5, 2007

(30) Foreign Application Priority Data

Aug. 26, 2005 (JP) ..... 2005-246437

(51) Int. Cl.
*B24B 55/10* (2006.01)

(52) U.S. Cl. ..... 451/443; 451/56; 451/72

(58) Field of Classification Search ..... 451/56, 451/443, 444
See application file for complete search history.

(56) References Cited

U.S. PATENT DOCUMENTS 5,707,492 A * 1/1998 Stager et al. ..... 438/693
6,106,382 A * 8/2000 Sakaguchi ..... 451/443
6,270,396 B1 * 8/2001 Uchiyama ..... 451/56
6,371,836 B1 * 4/2002 Brown et al. ..... 451/56
6,953,390 B2 * 10/2005 Sakurai et al. ..... 451/56
7,033,253 B2 * 4/2006 Dunn ..... 451/56
7,063,599 B2 * 6/2006 Kramer ..... 451/56
7,182,680 B2 * 2/2007 Butterfield et al. ..... 451/443
2003/0190874 A1 * 10/2003 So ..... 451/56

FOREIGN PATENT DOCUMENTS

JP 2004-1152 1/2004

* cited by examiner

*Primary Examiner*—Dung Van Nguyen
(74) *Attorney, Agent, or Firm*—David S. Safran; Roberts Mlotkowski Safran & Cole, P.C.

(57) ABSTRACT

The present invention provides a pad conditioner for dressing a surface of a polishing pad which is used in a polishing apparatus for polishing works, comprising: a substrate disposed opposite to the polishing pad; a plurality of pellets removably attached to the substrate; and a plurality of linear elastic members which have tip ends and are implanted into the pellets, wherein upon contact of the tip ends of the linear elastic members with the polishing pad, the linear elastic members elastically deform, so that a pressure necessary for conditioning the pad is generated in order to maintain a change in conditioning capability within a predetermined range and have a wide margin for adjusting a height of the conditioner.

15 Claims, 8 Drawing Sheets

RELATED ART

RELATED ART

PAD CONDITIONER, PAD CONDITIONING METHOD, AND POLISHING APPARATUS

BACKGROUND OF THE INVENTION

1. Field of the Invention

The present invention relates to a pad conditioner, a pad conditioning method, and a polishing apparatus, in particular, a pad conditioner which recovers a surface of a polishing pad in a polishing apparatus for polishing a work such as a semiconductor wafer, a polishing apparatus which is provided with the pad conditioner, and a pad conditioning method.

2. Description of the Related Art

As microstructure and multilayered structure of a semiconductor device have been achieved, CMP (Chemical Mechanical Polishing) technology has become essential in a manufacturing process of the semiconductor device. The CMP technology is now used for planarization of an insulating film between layers, as well as in various processes of Cu wiring and isolation, for example.

In the CMP technology for planarization, removal rate uniformity (polishing uniformity) across a work surface is an important specification. In order to improve the polishing uniformity, it is important to uniformly distribute any elements which affect the removal rate across a work surface.

While such important elements include a polishing pressure and a relative velocity in polishing, a surface state of a polishing pad is also an important element quantification of which is still in a preliminary stage. A preferable surface state of a polishing pad is achieved by conditioning the polishing pad. Also, a fact that, in a so-called in-situ conditioning in which a pad is conditioned during polishing, for example a stopping of the conditioning suddenly drops a removal rate, shows that a precise control of a surface state of a polishing pad is important.

Pad conditioning is an act to bring a pad conditioner having grinders such as diamond into contact with a polishing pad to scrape or roughen a surface of the polishing pad, so that a surface state of a new polishing pad is optimized as an initial state or the slurry holding capacity of the polishing pad in use is recovered to maintain its polishing capability.

Conventionally, pad conditioners having diamond abrasive particles electro-deposited thereto have been often used to condition a polishing pad by being pressed against the polishing pad while rotating around its central axis (for example, see Japanese Patent Application Laid-Open No. 2003-211355).

FIG. 7 shows a schematic view to illustrate a pad conditioner described in the Japanese Patent Application Laid-Open No. 2003-211355. The pad conditioner 130 described in the Japanese Patent Application Laid-Open No. 2003-211355 includes, as shown in FIG. 7, a substrate 131 having diamond abrasive particles 133 electro-deposited thereto, and a supporting section 132 to which the substrate 131 is fixedly attached.

In the pad conditioner 130, the tip ends of the diamond abrasive particles 133 are gradually abraded after repetition of pad conditionings, which in turn gradually reduces the conditioning capability of the conditioner 130, eventually leading to the end of its life. At the end of the life of the pad conditioner 130, the used substrate 131 having the abraded diamond abrasive particles 133 electro-deposited thereto is exchanged for a substrate 131 having new diamond abrasive particles 133 electro-deposited thereto.

In this case, the exchange of the used substrate for a new one 131 suddenly recovers the pad conditioning capability of the conditioner which will be again gradually lowered, and this generates an unpreferable behavior of the removal rate of a polishing apparatus which dramatically changes from a suddenly recovered level into a lower level over time, as shown by a dotted line of FIG. 4 which will be explained below. T1 and T2 in FIG. 4 show the timings for exchanging conditioner substrates.

In order to sustain this change, various pad conditioners and pad conditioning methods have been proposed (for example, see Japanese Patent Application Laid-Open No. 2004-001152). FIG. 8 is a schematic view to illustrate a pad conditioner described in the Japanese Patent Application Laid-Open No. 2004-001152.

The pad conditioner 120 described in the Japanese Patent Application Laid-Open No. 2004-001152 includes, as shown in FIG. 8, a plurality of conditioning pellets 121 having diamond abrasive particles electro-deposited thereto, and a base plate 122 to which each of the pellets 121 are removably and independently attached via a height adjusting device 124.

In this pad conditioner 120, the used conditioning pellets 121 can be individually exchanged for new conditioning pellets 121 depending on the abraded level of each conditioning pellet 121, so that a pad can be conditioned by the pad conditioner 120 with the used and new conditioning pellets 121 being simultaneously provided thereto.

SUMMARY OF THE INVENTION

In the case of the pad conditioner 120 described in the Japanese Patent Application Laid-Open No. 2004-001152, for example, if the exchanged new conditioning pellet 121 has a height different from those of the other conditioning pellets 121, the influence onto the other conditioning pellets 121 caused by the difference, especially the influence on adjacent conditioning pellets 121, is not negligible, and may significantly change the conditioning capability of the pad conditioner 120.

Thus, the pad conditioner 120 described in the Japanese Patent Application Laid-Open No. 2004-001152 is provided with a spacer 124 which function as a height adjusting device for each conditioning pellet 121. However, in order to adjust the heights, the spacer 124, first of all, needs adjustments by grinding or the like to have an appropriate thickness, which is hard and requires considerable man-hours.

Also, the pad conditioner 120 described in the Japanese Patent Application Laid-Open No. 2004-001152 may include conditioning pellets 121 attached to the base plate 122 via an elastic member such as rubber other than the spacer 124.

However, because the elastic member only evenly affects a plurality of diamond abrasive particles electro-deposited to the conditioning pellets 121, and cannot sufficiently sustain the influence onto the other conditioning pellets 121, in this case with the elastic member also, an exact height adjustment by a process using the spacer 124 is required.

The elastic member has another problem that, when frictional force is applied to the conditioning pellets 121 during conditioning a polishing pad, the member disturbs the orientation of the conditioning pellets 121 which should be in contact with the pad in parallel. In this case, each conditioning pellet 121 intermittently contacts with the polishing pad due to the frictional force, which causes a side effect of a significant inhibition of uniform conditioning.

The present invention was made in view of the problems described above, and one of the objects of the present invention is to provide: a pad conditioner which, in conditioning a polishing pad of a polishing apparatus such as a CMP apparatus, is able to maintain a change in conditioning capability within a predetermined range and has a wide margin for adjusting a height of the conditioner, and in which a mounted height of the conditioner does not influence a conditioning pressure much; a pad conditioning method using the same; and a polishing apparatus equipped with the same.

In order to achieve the above object, a first aspect of the present invention provides a pad conditioner for dressing a surface of a polishing pad which is used in a polishing apparatus for polishing works, comprising: a substrate disposed opposite to the polishing pad; a plurality of pellets removably attached to the substrate; and a plurality of linear elastic members which have tip ends and are implanted into the pellets, wherein upon contact of the tip ends of the linear elastic members with the polishing pad, the linear elastic members elastically deform, so that a pressure necessary for conditioning the pad is generated.

According to the first aspect of the present invention, as a plurality of pellets to which a plurality of linear elastic members are implanted are removably attached to a substrate disposed opposite to a polishing pad, any pellets can be exchanged for new pellets at any time, so that old and new pellets to which a plurality of linear elastic members are implanted are simultaneously provided thereto for conditioning a pad. In addition, the deformation of linear elastic members provides a wide margin for adjustment, which eliminates height adjustments in exchanging pellets.

A second aspect of the present invention provides a pad conditioner for dressing a surface of a polishing pad which is used in a polishing apparatus for polishing works, comprising: a supporting section of a solid cylindrical, hollow cylindrical or hog-backed shape having an axis which is disposed parallel to the polishing pad; and a plurality of linear elastic members which have tip ends and are implanted into the circumferential surface of the supporting section, wherein upon contact of the tip ends of the linear elastic members with the polishing pad, the linear elastic members elastically deform, so that a pressure necessary for conditioning the pad is generated.

A third aspect of the present invention provides the pad conditioner according to the second aspect of the present invention, further comprising: a rotating device which rotates the supporting section around its central axis; and a controlling device which controls the rotating device to rotate the supporting section around its central axis by a predetermined angle at predetermined time intervals.

According to the third aspect of the present invention, because the supporting section of a solid cylindrical or hollow cylindrical shape having a plurality of linear elastic members implanted thereto is rotated around its central axis by a predetermined angle at predetermined time intervals, a part of the plurality of linear elastic members which contribute to the conditioning of a pad can be exchanged for new linear elastic members.

A fourth aspect of the present invention provides a pad conditioner for dressing a surface of a polishing pad which is used in a polishing apparatus for polishing works, comprising: a circular substrate disposed in an inclined orientation toward the polishing pad; and a plurality of linear elastic members which are implanted to form a cup shape with the circular substrate, wherein upon contact of the tip ends of the linear elastic members with the polishing pad, the linear elastic members elastically deform, so that a pressure necessary for conditioning the pad is generated.

A fifth aspect of the present invention provides the pad conditioner according to the fourth aspect of the present invention, further comprising: a rotating device which rotates the circular substrate around its central axis that is perpendicular to the substrate at the center thereof; and a controlling device which controls the rotating device to rotate the circular substrate around its central axis by a predetermined angle at predetermined time intervals.

According to the fifth aspect of the present invention, because the circular substrate having a plurality of linear elastic members implanted thereto to form a cup shape is rotated by a predetermined angle at predetermined time intervals around its central axis which is perpendicular to the substrate at the center thereof, a part of the plurality of linear elastic members which contribute to the conditioning of a pad can be exchanged for new linear elastic members.

A sixth aspect of the present invention provides the pad conditioner according to any one of the first to fifth aspects of the present invention, wherein each of the plurality of linear elastic members includes a tip end to which a tip piece is fixed, the tip piece being made of a material having high hardness and wear resistance.

According to the sixth aspect of the present invention, due to the tip pieces fixed to each tip end of the linear elastic members, which are made of a material having high hardness and wear resistance, a pad can be efficiently conditioned with less abrasion of the conditioner. This allows the conditioner to be maintained to constantly grind an amount of a pad.

A seventh aspect of the present invention provides a polishing apparatus, comprising the pad conditioner according to any one of the first to sixth aspects of the present invention. According to the seventh aspect of the present invention, polishing can be well achieved with less change in removal rates.

An eighth aspect of the present invention provides a pad conditioning method for dressing a surface of a polishing pad which is used in a polishing apparatus for polishing works, comprising: using the pad conditioner according to any one of the first to sixth aspects of the present invention; and exchanging a part of the plurality of linear elastic members which contribute to the conditioning of the pad for new linear elastic members at predetermined time intervals, so that a change in pad conditioning capability of the pad conditioner is maintained within a predetermined range.

According to the eighth aspect of the present invention, because a part of the plurality of linear elastic members which contribute to the conditioning of a pad are exchanged for new linear elastic members to maintain a change in pad conditioning capability of the pad conditioner within a predetermined range, polishing can be well achieved with less change in removal rates.

A ninth aspect of the present invention provides a pad conditioning method for dressing a surface of a polishing pad which is used in a polishing apparatus for polishing works, comprising: using the pad conditioner according to the first aspect of the present invention; and exchanging a part of the plurality of linear elastic members which contribute to the conditioning of a pad for new linear elastic members at predetermined time intervals by exchanging the pellets at predetermined time intervals, so that a change in pad conditioning capability of the pad conditioner is maintained within a predetermined range.

According to the ninth aspect of the present invention, because the exchange of pellets at predetermined time intervals eliminates height adjustments, and a change in pad conditioning capability of the pad conditioner is easily maintained within a predetermined range, polishing can be well achieved with less change in removal rates.

A tenth aspect of the present invention provides a pad conditioning method for dressing a surface of a polishing pad which is used in a polishing apparatus for polishing works, comprising: using the pad conditioner according to the third aspect of the present invention; and exchanging a part of the plurality of linear elastic members which contribute to the conditioning of a pad for new linear elastic members at predetermined time intervals by rotating the supporting section around its central axis at predetermined time intervals, so that a change in pad conditioning capability of the pad conditioner is maintained within a predetermined range.

An eleventh aspect of the present invention provides a pad conditioning method for dressing a surface of a polishing pad which is used in a polishing apparatus for polishing works, comprising: using the pad conditioner according to the fifth aspect of the present invention; and exchanging a part of the plurality of linear elastic members which contribute to the conditioning of a pad for new linear elastic members at predetermined time intervals by rotating the circular substrate around its central axis which is perpendicular to the substrate at the center thereof at predetermined time intervals, so that a change in pad conditioning capability of the pad conditioner is maintained within a predetermined range.

According to the tenth or eleventh aspect of the present invention, because a part of the plurality of linear elastic members which contribute to the conditioning of a pad can be automatically exchanged for new linear elastic members even during polishing at predetermined time intervals so that a change in pad conditioning capability of the pad conditioner is maintained within a predetermined range, polishing can be well achieved with less change in removal rates.

As described above, according to a pad conditioner and a pad conditioning method of the present invention, a change in pad conditioning capability of the pad conditioner is maintained within a predetermined range, and a wide margin of height adjustments is assured, thereby a mounted height of a conditioner does not influence much on a conditioning pressure. Also, according to a polishing apparatus of the present invention, a process on a work can be well achieved with excellent removal rate uniformity across a work surface.

DETAILED DESCRIPTION OF THE PREFERRED EMBODIMENTS

Figure 1:
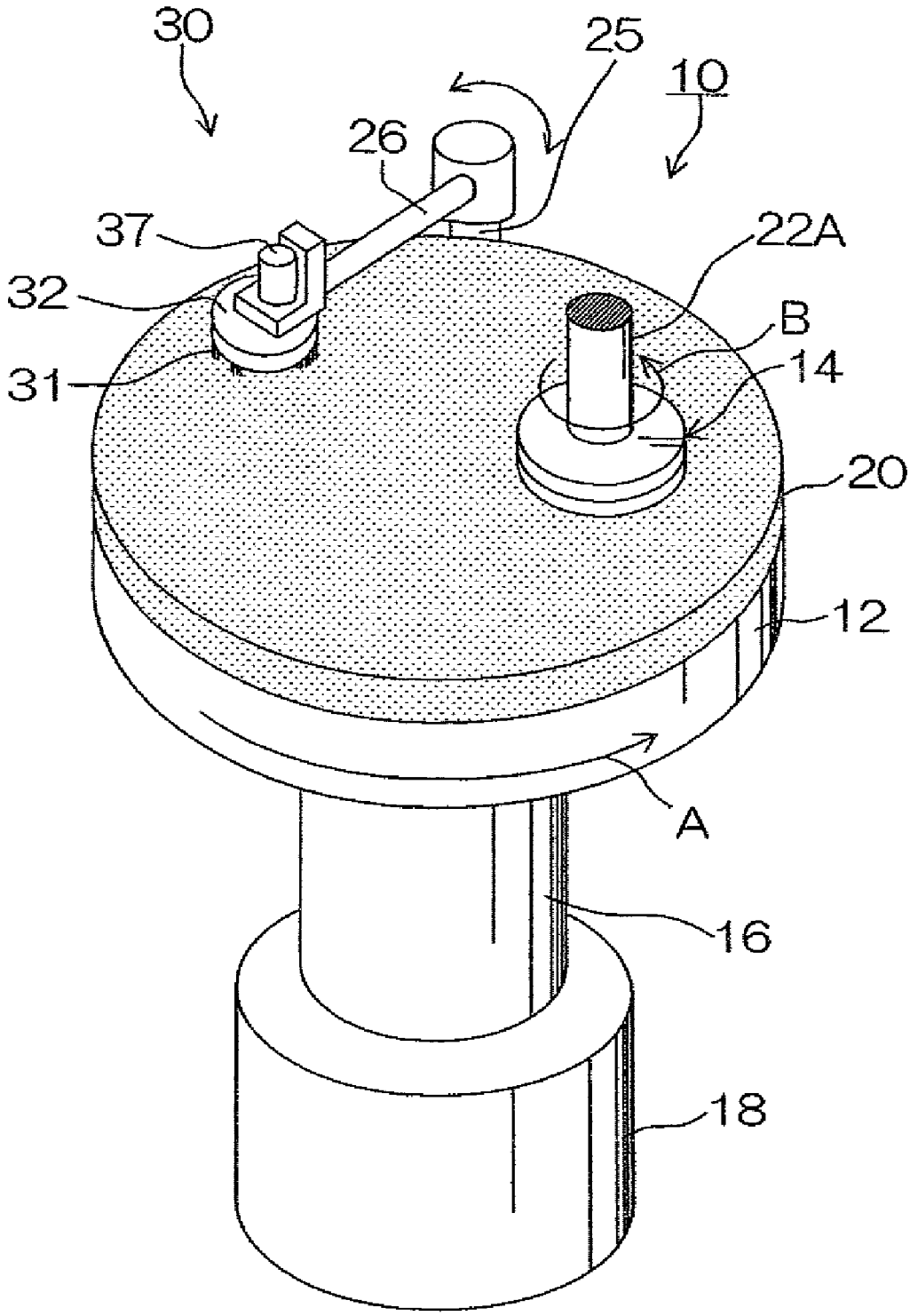
FIG. 1 is a perspective view to show an embodiment of a polishing apparatus according to the present invention.

Now, preferable embodiments of a pad conditioner, a pad conditioning method, and a polishing apparatus according to the present invention will be explained below in detail with reference to the accompanying drawings. Throughout the drawings, similar reference numerals or characters are used to designate the similar members.

FIG. 1 is a perspective view to show an embodiment of a polishing apparatus according to the present invention. A polishing apparatus 10 of FIG. 1 generally includes a polishing plate 12, a wafer carrier 14, and a pad conditioner 30.

The polishing plate 12 has a rotating shaft 16, and a driving of a motor 18 which is coupled to the shaft 16 causes the polishing plate 12 to rotate in a direction shown by the arrow A in FIG. 1. The wafer carrier 14 holding a work of wafer has a rotating shaft 22A, and a driving of a motor (not shown) which is coupled to the shaft 22A causes the wafer carrier to rotate in a direction shown by the arrow B in FIG. 1. The polishing plate 12 has an upper surface onto which a polishing pad 20 is attached, and slurry is supplied from a slurry supply nozzle (not shown) over the polishing pad 20.

The pad conditioner 30 is pressed against a surface of the rotating polishing pad 20 to condition the surface to maintain its polishing capability, by optimizing the surface of the polishing pad 20 as an initial state when the pad is a new one, or cleaning clogging of the surface of the polishing pad 20 when the pad is in use so that the slurry holding capacity of the polishing pad is recovered.

Figure 2:
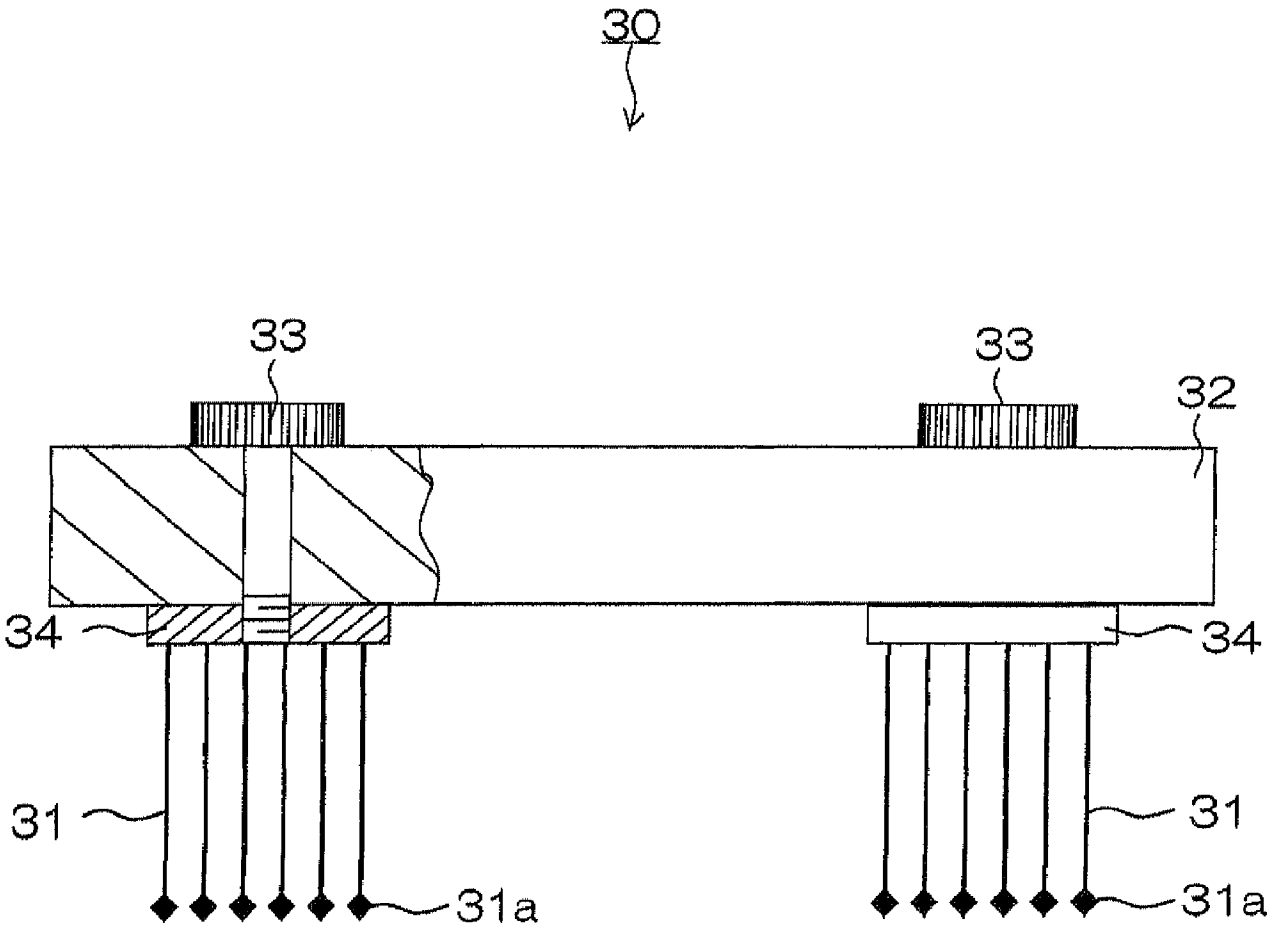
FIG. 2 is a side view to show a configuration of a pad conditioner according to the present invention.
Figure 3:
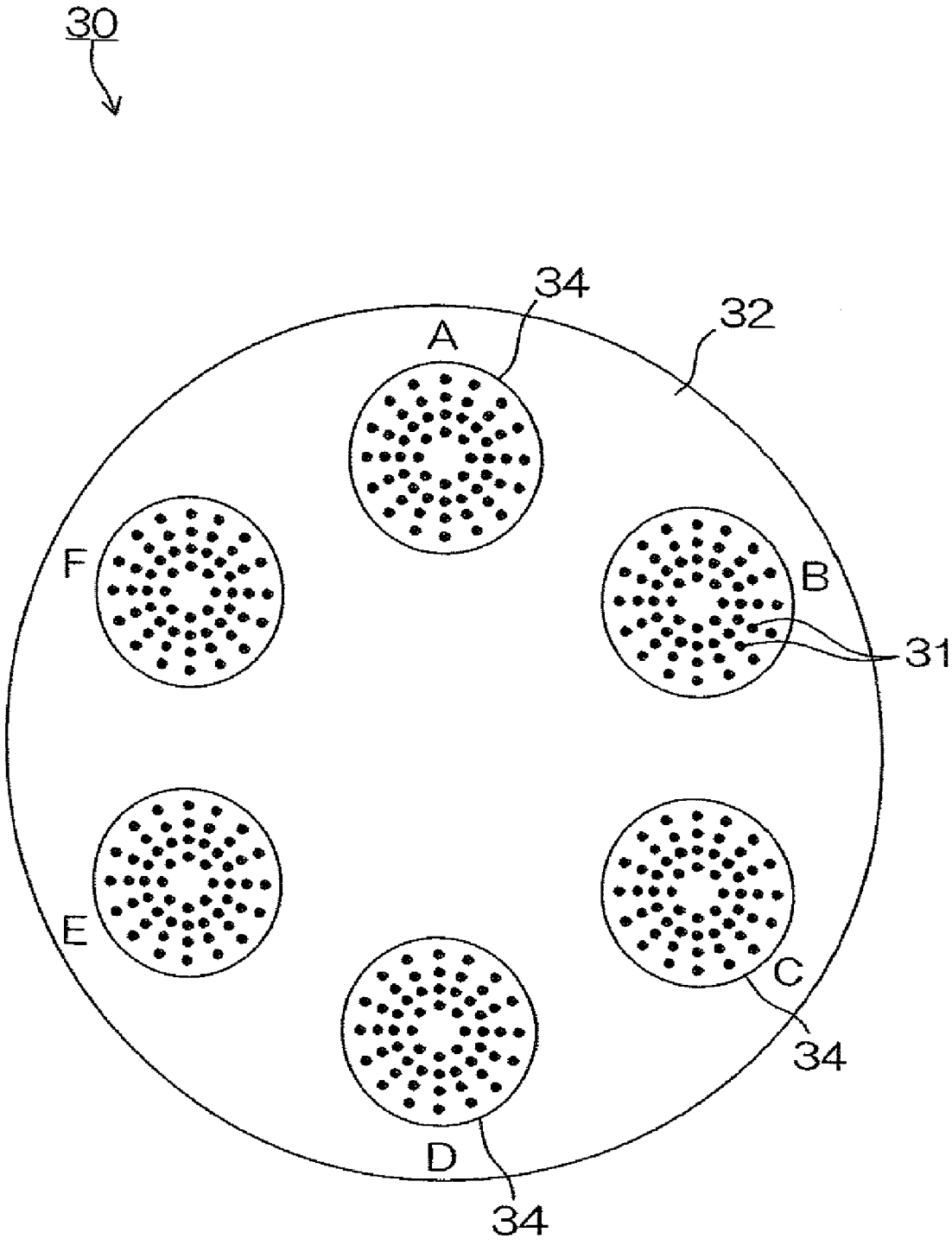
FIG. 3 is a top plan to show a configuration of a pad conditioner according to the present invention.

FIG. 2 and FIG. 3 are schematic views to show a pad conditioner 30 according to the present invention. FIG. 2 is a side view; and FIG. 3 is a top plan view. The pad conditioner 30 generally includes a disc-like substrate 32, and six pellets 34 to which a number of linear elastic members 31 are planted (hereinafter, it may be referred to as "implanted" which is more suitable to the image). The number of the pellets 34 is not limited to six.

Each pellet 34 is removably attached to the substrate 32 by a fixing screw 33. Each linear elastic member 31 has a tip end to which a tip piece 31*a* is fixedly attached. The linear elastic members 31 may be preferably piano wires, carbon fibers, and the like.

The tip pieces 31*a* fixedly attached to the tip ends of the linear elastic members 31 are preferably made of a material having high hardness and wear resistance, and diamond abrasive particles or the like are fixed to the tip pieces 31*a* by electro-deposition. In stead of the diamond abrasive particles, WC or cemented carbide may be used.

When carbon fibers having high hardness are used for the linear elastic members 31, the tip ends themselves of the carbon fibers may be used for conditioning without fixedly attaching the tip pieces 31*a* thereto.

In order to implant (plant) the linear elastic members 31 into the pellets 34, as one method, the linear elastic members 31 may be inserted into holes which are formed in the pellets 34 so as to be adhesively secured therein, but other methods including spot welding may be used.

In the pad conditioner 30 according to the present invention, a conditioning pressure P can be represented by the following formula (1), where a Young's modulus of the elastic member 31 is E, an effective flexible length of the elastic member 31 is L, a thickness of the elastic member 31 is t, a width of the elastic member 31 is b, a coefficient of friction between the tip piece 31*a* and the polishing pad 20 is μ, a displacement in a horizontal direction, and a horizontal displacement caused by deflection of the elastic member 31 is δ.

$$P = \frac{Ebt^3\delta}{6(\delta^2 + L^2)(\mu L + \delta)} \tag{1}$$

Even when a surface waviness of the polishing pad 20 is 50 μm, optimization of the values of E, L, t, and b of the elastic member 31 makes the variation in the conditioning pressures P less than 1%.

In order to condition the polishing pad 20, the tip pieces 31*a* of the pad conditioner 30 are brought into contact with the surface of the rotating polishing pad 20, and then the substrate 32 is approached to the polishing pad 20 by a predetermined distance so that the linear elastic members 31 are bended. The elastic deformation of the linear elastic members 31 creates a conditioning pressure which makes the surface of the polishing pad 20 to be conditioned. In this case, the amount of bending of the linear elastic members 31 can be adjusted to obtain an optimal conditioning pressure.

The tip pieces 31*a* follow the different heights of the surface of the polishing pad 20 caused by the surface waviness, and a stress variation which corresponds to a variation in the amount of bending of the linear elastic members 31 caused by the following is small, thereby a more uniform conditioning over the surface of the polishing pad 20 can be achieved.

As shown in FIG. 1, rotating the substrate 32 by the motor 37 causes all of the pellets 34 to operate the conditioning uniformly. Also as shown in FIG. 1, the pad conditioner 30 is mounted to an arm 26 which is fixed to a rotating shaft 25, and is moved in a reciprocating manner between a central portion and a peripheral portion of the polishing pad 20 to condition the polishing pad 20, which improves the uniformity of conditioning across the polishing pad surface.

The pad conditioning is a so called in-situ conditioning which is simultaneously performed with polishing of a work of wafer, and sharp edges of the operating tip pieces 31*a* of the linear elastic members 31 will be abraded over time. Thus, the pellets 34 are exchanged for new pellets 34 at predetermined time intervals.

In exchanging the pellets 34, for example, the pellets 34 at A and D positions in FIG. 3 are exchanged at the exchange timing t1 in FIG. 4 which will be explained below, the pellets 34 at B and E positions in FIG. 3 are exchanged at the next exchange timing t2, the pellets 34 at C and F positions in FIG. 3 are exchanged at the next exchange timing t3, and so on. This makes the old and new pellets 34 constantly provided together for conditioning a pad with the tip pieces 31*a* of the number of linear elastic members 31 which are of different abrasion levels.

Since only a part of the pellets 34 are exchanged at one time among the all, a change in the removal rate caused by the exchanging is small. FIG. 4 is a graph to show the change. In FIG. 4, the horizontal axis represents number of polished wafers and timings to exchange conditioners, and the vertical axis represents removal rate.

Figure 4:
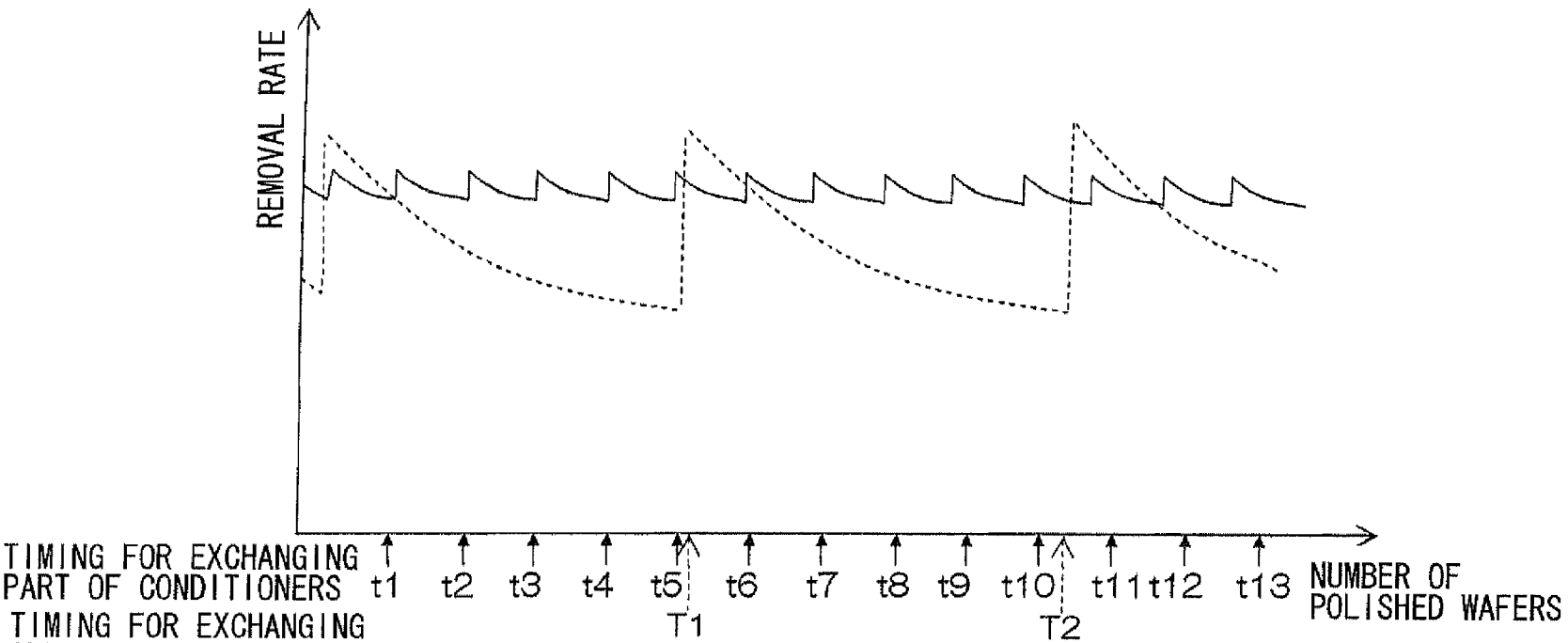
FIG. 4 is a graph to illustrate changes of removal rates.

The removal rates of a wafer when the pellets 34 are exchanged at the exchange timings t1, t2, . . . are shown in a solid line in FIG. 4. The peak removal rates (the top points of curves) are limited to about 70% of the removal rates at the conventional timings T1 and T2 when all of the conditioners are exchanged (a dotted curve in FIG. 4), but the change widths of the removal rates are extremely smaller compared to those in the case in which all of the conditioners are exchanged.

In the present invention, the linear elastic members 31 are used, and due to the stress caused by the bended linear elastic members 31, a conditioning pressure is generated. However, a change in the bending is reflected into a less change of conditioning pressures, thereby an exchange of some pellets 34 causes almost no influence onto adjacent pellets 34, which eliminates the height adjustments of linear elastic members 31 due to the exchange. This makes the exchanges easy and the apparatus may be stopped for the exchanges only for a short period of time.

Therefore, in the pad conditioning method according to the present invention, since the pad conditioning capability is under the maximum limit (e.g. 70%), and also the change width of the pad conditioning capability is limited to a small amount, the pad conditioner can be stable with a long life.

Figure 5:
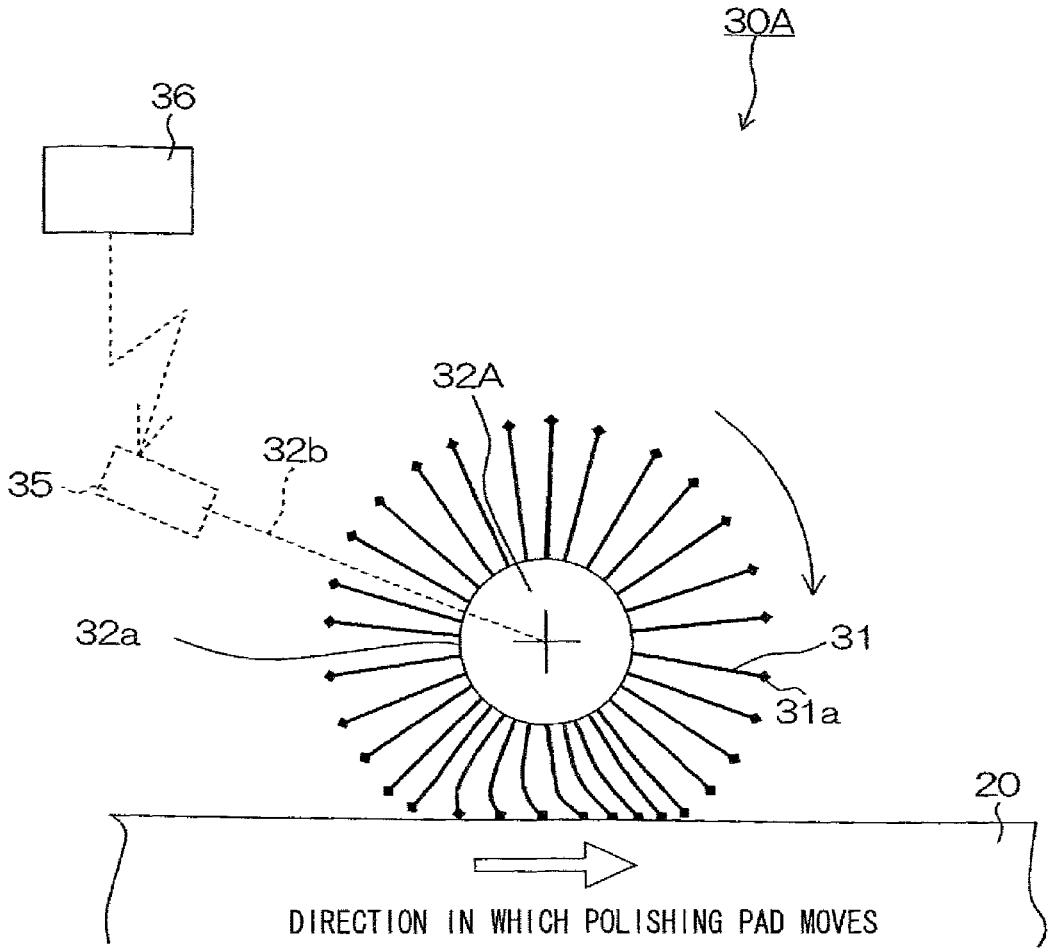
FIG. 5 is a schematic view to show a configuration of a pad conditioner according to the second aspect of the present invention.

FIG. 5 is a schematic view to show an embodiment of a pad conditioner 30A according to the second aspect of the present invention. The pad conditioner 30A generally comprises: a supporting section 32A of a solid cylindrical, hollow cylindrical or hog-backed shape; a plurality of linear elastic members 31 which have tip ends and are implanted into a circumferential surface 32*a* of the supporting section 32A; a rotating device 35 connected to a central axis 32*b* of the supporting section 32A for rotating the supporting section 32A around the central axis 32*b*; and a controlling device 36 which controls the rotation of the rotating device 35.

Each linear elastic member 31 has a tip end to which a tip piece 31*a* is fixedly attached. The supporting section 32A has a central axis 32*b* which is disposed parallel to a surface of a polishing pad 20, and is configured so that a conditioning pressure is generated when the tip pieces 31*a* of the linear elastic members 31 facing toward the surface of a polishing pad 20 are brought into contact with the polishing pad 20 and the linear elastic members 31 are bended.

The linear elastic members 31 may be preferably piano wires, carbon fibers, and the like, i.e., are members that can be described as strands. The tip pieces 31*a* fixedly attached to the tip ends of the linear elastic members 31 are preferably made of a material having high hardness and wear resistance, and diamond abrasive particles or the like are fixed to the tip pieces 31*a* by electro-deposition. Instead of the diamond abrasive particles, WC or cemented carbide may be used.

When carbon fibers having high hardness are used for the linear elastic members 31, the tip ends themselves of the carbon fibers may be used for conditioning without fixedly attaching the tip pieces 31*a* thereto.

In order to implant (plant) the linear elastic members 31 into the pellets 34, as one method as in the previous aspect of the present invention, the linear elastic members 31 may be inserted into holes which are formed in the pellets 34 so as to be adhesively secured therein, but other methods including spot welding may be used.

In a pad conditioning, the controlling device 36 controls the rotating device 35 such as a motor to rotate the supporting section 32A by a predetermined angle at predetermined time intervals. This allows the plurality of abraded tip pieces 31*a* to be separated from the polishing pad 20, and then this part of the tip pieces 31*a* are exchanged for a plurality of new tip pieces 31*a* which contribute to pad conditioning, so that the old and new tip pieces 31*a* can be constantly provided together for conditioning a pad. Thus, a change in pad conditioning capability can be maintained within a small range, and a change in removal rates also can be limited to a small amount.

The partial exchange of the old and new linear elastic members 31 which contribute to pad conditioning can be automatically performed during polishing of a work of wafer, which allows the wafer to be consistently polished at a generally constant removal rate.

Figure 6:
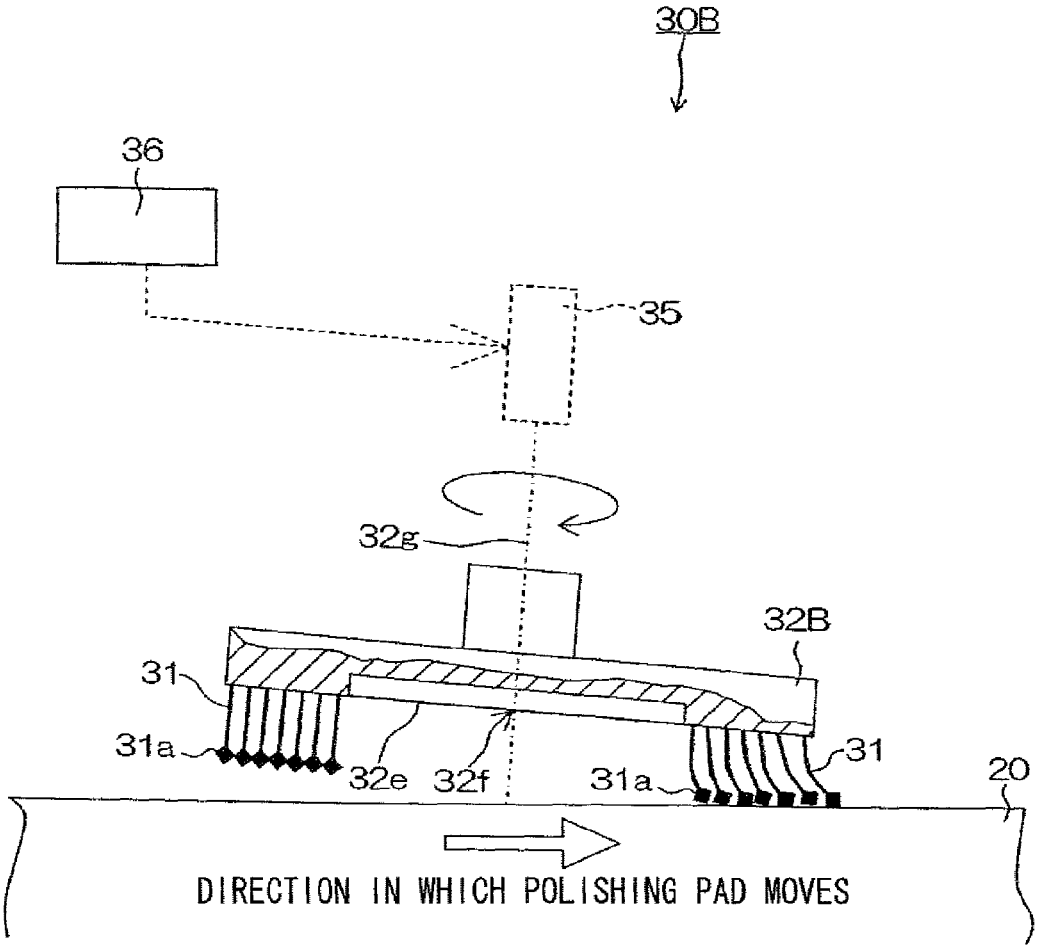
FIG. 6 is a schematic view to show a configuration of a pad conditioner according to the third aspect of the present invention.
Figure 7:
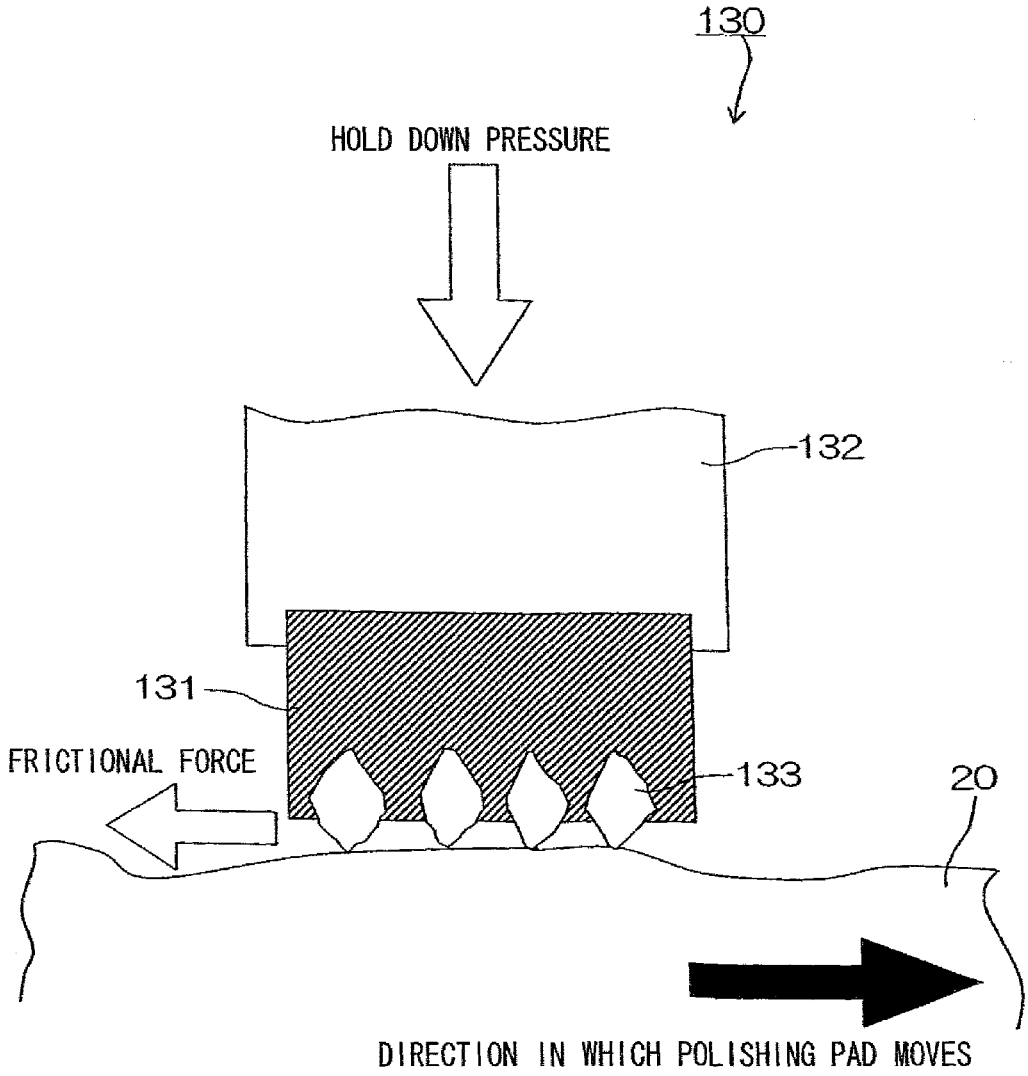
FIG. 7 is a schematic view to show a conventional pad conditioner.
Figure 8:
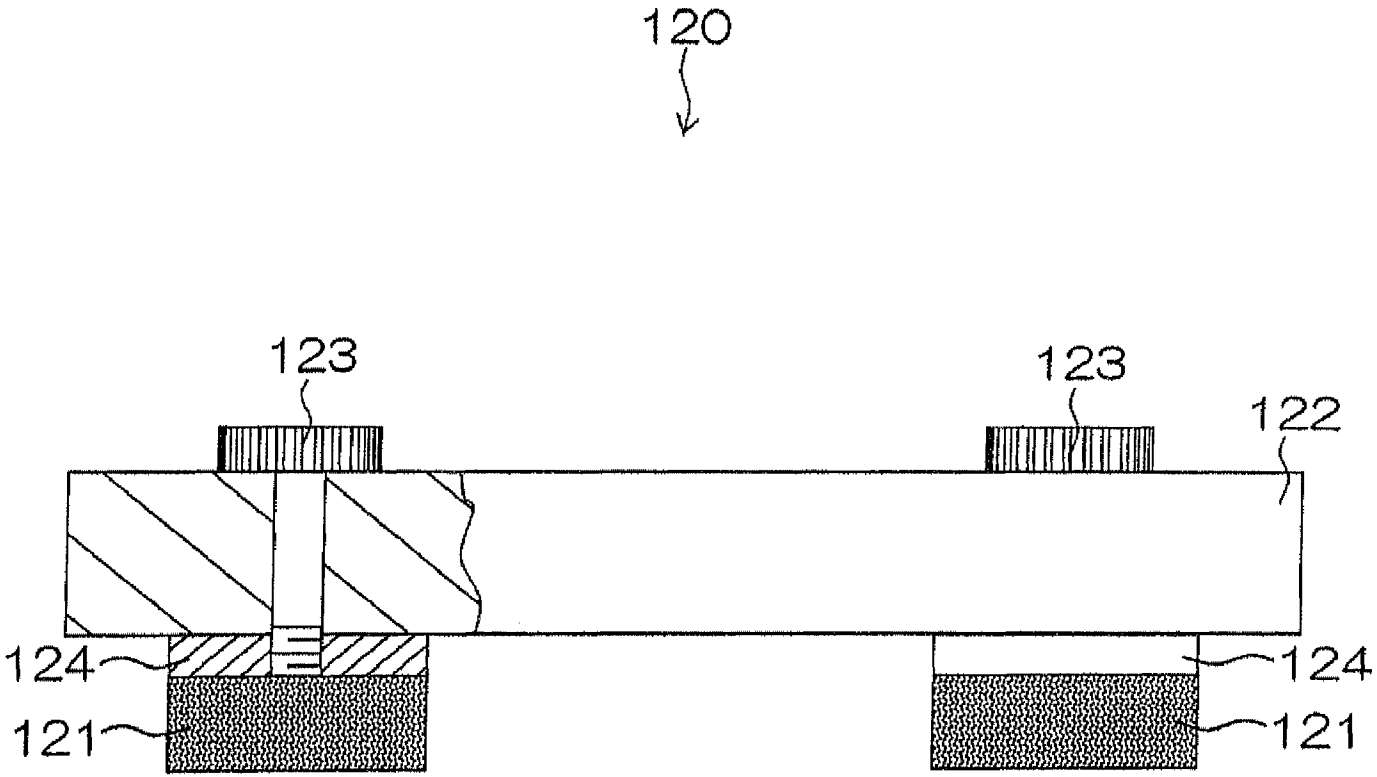
FIG. 8 is a side view to show another conventional pad conditioner.

FIG. 6 is a schematic view to show an embodiment of a pad conditioner 30B according to a third aspect of present invention. The pad conditioner 30B generally comprises a circular substrate 32B having a circular substrate surface 32*e* and a central axis 32*g* which is perpendicular to the circular substrate surface 32*e* at the center of the circle 32*f*; a number of linear elastic members 31 which are implanted to form a cup shape with the circular substrate surface 32*e*, a rotating device 35 disposed along the central axis 32*g* to rotate the circular substrate 32B around the central axis 32*g*; and a controlling device 36 which controls the rotation of the rotating device 35.

Each linear elastic member 31 has a tip end to which a tip piece 31*a* is fixedly attached. The circular substrate 32B is disposed so that the circular substrate surface 32*e* is oriented at an angle to a surface of the polishing pad 20, and is also disposed so that a conditioning pressure is generated when the tip pieces 31*a* of the linear elastic members 31 are brought into contact with the surface of the polishing pad 20 and the linear elastic members 31 are bended.

As in the previous aspect of the present invention, the linear elastic members 31 may be preferably piano wires, carbon fibers, and the like. The tip pieces 31*a* fixedly attached to the tip ends of the linear elastic members 31 are preferably made of a material having high hardness and wear resistance, and diamond abrasive particles or the like are fixed to the tip pieces 31*a* by electro-deposition. In stead of the diamond abrasive particles, cemented carbide may be used.

When carbon fibers having high hardness are used for the linear elastic members 31, the tip ends themselves of the carbon fibers may be used for conditioning without fixedly attaching the tip pieces 31*a* thereto.

In order to implant (plant) the linear elastic members 31 into the pellets 34, as one method as in the previous aspect of the present invention, the linear elastic members 31 may be inserted into a number of holes which are formed in the pellets 34 so as to be adhesively secured therein, but other methods including spot welding may be used.

In a pad conditioning, the controlling device 36 controls the rotating device 35 such as a motor to rotate the circular substrate 32B by a predetermined angle at predetermined time intervals. This allows the plurality of abraded tip pieces 31*a* to be separated from the polishing pad 20, and then this part of the tip pieces 31*a* are exchanged for a plurality of new tip pieces 31*a* which contribute to pad conditioning, so that the old and new tip pieces 31*a* can be constantly provided together for conditioning a pad. Thus, a change in pad conditioning capability can be maintained within a small range, and a change in removal rates also can be limited to a small amount.

The partial exchange of the old and new linear elastic members 31 which contribute to pad conditioning can be automatically performed during polishing of a work of wafer, which allows the wafer to be consistently polished at a generally constant removal rate.

As described above, according to a pad conditioner and a pad conditioning method using the same of the present invention, a pad conditioner the mounted height of which does not influence a conditioning pressure much and a pad conditioning method which makes a pad conditioner have a long life and a small change in pad conditioning capability can be provided.

According to the polishing apparatus 10 of the present invention, since the polishing apparatus 10 includes the pad conditioner which performs such a pad conditioning, a polishing can be well done at a stable removal rate in the polishing apparatus 10.

What is claimed is:

1. A pad conditioner for dressing a surface of a polishing pad which is used in a polishing apparatus for polishing works, comprising:

a supporting section of one of a solid cylindrical, hollow cylindrical and hog-backed shape having a central axis which is disposed parallel to the polishing pad;

a rotating device which rotates the supporting section around said central axis;

a controlling device which controls the rotating device to rotate the supporting section around said central axis by a predetermined angle at a predetermined time intervals;

a plurality of linear elastic members which have abrasive tip ends and which are implanted into a circumferential surface of the supporting section, wherein upon contact of the tip ends of the linear elastic members with the polishing pad, the linear elastic members elastically deform in a manner enabling the tip ends to follow different heights of the surface of the polishing pad caused by surface waviness in order to uniformly perform conditioning over the surface of the polishing pad.

2. A polishing apparatus, comprising the pad conditioner according to claim 1.

3. A pad conditioner for dressing a surface of a polishing pad which is used in a polishing apparatus for polishing works, comprising:

a supporting section of a solid cylindrical, hollow cylindrical or hog-backed shape having an axis which is disposed parallel to the polishing pad;

a plurality of elastic strands which have tip ends and are implanted into the circumferential surface of the supporting section;

a rotating device which rotates the supporting section around its central axis; and a controlling device which controls the rotating device to rotate the supporting section around its central axis by a predetermined angle at predetermined time intervals;

wherein the tip end of each of the plurality of elastic strands is fixed to a tip piece, the tip piece being made of a material having high hardness and wear resistance;

wherein upon contact of the tip ends of the elastic strands with the polishing pad, the elastic strands elastically deform, so that a pressure necessary for conditioning the pad is generated.

4. A polishing apparatus, comprising the pad conditioner according to claim 3.

5. A pad conditioner for dressing a surface of a polishing pad which is used in a polishing apparatus for polishing works, comprising:

a circular substrate disposed in an inclined orientation toward the polishing pad;

a rotating device which rotates the circular substrate around its central axis that is perpendicular to the substrate at the center thereof;

a controlling device which controls the rotating device to rotate the circular substrate around its central axis by a predetermined angle at predetermined time intervals;

a plurality of elastic strands which are implanted to form a cup shape with the circular substrate;

wherein each of the plurality of linear elastic strands includes a tip end to which a tip piece is fixed, the tip piece being made of a material having high hardness and wear resistance;

wherein upon contact of the tip ends of the elastic strands with the polishing pad, the elastic strands elastically deform, so that a pressure necessary for conditioning the pad is generated.

6. A polishing apparatus, comprising the pad conditioner according to claim 5.

7. A pad conditioner for dressing a surface of a polishing pad which is used in a polishing apparatus for polishing works, comprising:

a circular substrate having a circular substrate surface;

a central axis which is perpendicular to the circular substrate surface at a center of the circular substrate;

a plurality of linear elastic members which are implanted in the circular substrate surface so as to form a cup shaped therewith and which have abrasive tip pieces on free ends thereof;

a rotating device disposed along the central axis to rotate the circular substrate around the central axis;

a controlling device which controls the rotation of the rotating device in the conditioner;

wherein the circular substrate is disposed so that the circular substrate surface is oriented at an oblique angle to a surface of the polishing pad and is also disposed in a manner enabling the tip pieces to follow different heights of the surface of the polishing pad caused by surface waviness in order to uniformly perform conditioning over the surface of the polishing pad.

8. The pad conditioner according to claim 7, wherein the plurality of linear elastic members are elastic strands that are made of one of piano wires and carbon fibers.

9. A pad conditioning method for dressing a surface of a polishing pad which is used in a polishing apparatus for polishing works, comprising:

providing a pad conditioner comprising a supporting section of one of a solid cylindrical, hollow cylindrical and hog-backed shape having a central axis which is disposed parallel to the polishing pad; a rotating device which rotates the supporting section around said central axis; a controlling device which controls the rotating device to rotate the supporting section around said central axis by a predetermined angle at a predetermined time intervals; a plurality of linear elastic members which have abrasive tip ends and which are implanted into a circumferential surface of the supporting section, wherein upon contact of the tip ends of the linear elastic members with the polishing pad, the linear elastic members elastically deform in a manner enabling the tip ends to follow different heights of the surface of the polishing pad caused by surface waviness in order to uniformly perform conditioning over the surface of the polishing pad; and exchanging only a part of the plurality of the linear elastic members which contribute to the conditioning of the pad and which have tip pieces which have become worn for linear elastic members with new tip pieces at predetermined time intervals, so that a change in pad conditioning capability of the pad conditioner is maintained within a predetermined range.

10. A pad conditioning method for dressing a surface of a polishing pad which is used in a polishing apparatus for polishing works, comprising:

providing a pad conditioner comprising a supporting section of a solid cylindrical, hollow cylindrical or hog-backed shape having an axis which is disposed parallel to the polishing pad; a plurality of elastic strands which have tip ends and are implanted into the circumferential surface of the supporting section, a rotating device which rotates the supporting section around its central axis; a controlling device which controls the rotating device to rotate the supporting section around its central axis by a predetermined angle at predetermined time intervals, wherein the tip end of each of the plurality of elastic strands is fixed to a tip piece, the tip piece being made of a material having high hardness and wear resistance wherein upon contact of the tip ends of the elastic strands with the polishing pad, the elastic strands elastically deform, so that a pressure necessary for conditioning the pad is generated; and exchanging a part of the plurality of elastic strands which contribute to the conditioning of the pad and which have tip pieces which have become worn for elastic strands with new tip pieces at predetermined time intervals by rotating the supporting section around its central axis at predetermined time intervals, so that a change in pad conditioning capability of the pad conditioner is maintained within a predetermined range.

11. A pad conditioning method for dressing a surface of a polishing pad which is used in a polishing apparatus for polishing works, comprising:

providing a pad conditioner comprising a supporting section of a solid cylindrical, hollow cylindrical or hog-backed shape having an axis which is disposed parallel to the polishing pad; a plurality of elastic strands which have tip ends and are implanted into the circumferential surface of the supporting section, a rotating device which rotates the supporting section around its central axis; and a controlling device which controls the rotating device to rotate the supporting section around its central axis by a predetermined angle at predetermined time intervals, wherein the tip end of each of the plurality of elastic strands is fixed to a tip piece, the tip piece being made of a material having high hardness and wear resistance, wherein upon contact of the tip ends of the elastic strands with the polishing pad, the elastic strands elastically deform, so that a pressure necessary for conditioning the pad is generated; and exchanging a part of the plurality of elastic strands which contribute to the conditioning of a pad and which have tip pieces which have become worn for Previously Presented elastic strands with Previous Presented tip pieces at predetermined time intervals, so that a change in pad conditioning capability of the pad conditioner is maintained within a predetermined range.

12. A pad conditioning method for dressing a surface of a polishing pad which is used in a polishing apparatus for polishing works, comprising:

providing a pad conditioner comprising a circular substrate disposed in an inclined orientation toward the polishing pad; a plurality of elastic strands which are implanted to form a cup shape with the circular substrate, a rotating device which rotates the circular substrate around its central axis that is perpendicular to the substrate at the center thereof; a controlling device which controls the rotating device to rotate the circular substrate around its central axis by a predetermined angle at predetermined time intervals, wherein each of the plurality of linear elastic strands includes a tip end to which a tip piece is fixed, the tip piece being made of a material having high hardness and wear resistance, wherein upon contact of the tip ends of the elastic strands with the polishing pad, the elastic strands elastically deform, so that a pressure necessary for conditioning the pad is generated; and exchanging a part of the plurality of elastic strands which contribute to the conditioning of the pad for new elastic strands at predetermined time intervals by rotating the circular substrate around its central axis which is perpendicular to the substrate at the center thereof at predetermined time intervals, so that a change in pad conditioning capability of the pad conditioner is maintained within a predetermined range.

13. A pad conditioning method for dressing a surface of a polishing pad which is used in a polishing apparatus for polishing works, comprising:

providing a pad conditioner comprising a circular substrate disposed in an inclined orientation toward the polishing pad; a plurality of elastic strands which are implanted to form a cup shape with the circular substrate, a rotating device which rotates the circular substrate around its central axis that is perpendicular to the substrate at the center thereof; and a controlling device which controls the rotating device to rotate the circular substrate around its central axis by a predetermined angle at predetermined time intervals, wherein each of the plurality of linear elastic strands includes a tip end to which a tip piece is fixed, the tip piece being made of a material having high hardness and wear resistance, wherein upon contact of the tip ends of the elastic strands with the polishing pad, the elastic strands elastically deform, so that a pressure necessary for conditioning the pad is generated; and exchanging a part of the plurality of elastic strands which contribute to the conditioning of a pad for new elastic strands at predetermined time intervals by rotating the circular substrate around its central axis which is perpendicular to the substrate at the center thereof at predetermined time intervals, so that a change in pad conditioning capability of the pad conditioner is maintained within a predetermined range.

14. A conditioning method for dressing a surface of a polishing pad which is used in a polishing apparatus for polishing works, comprising the steps of:

disposing a supporting section having an axis of rotation which is parallel to the polishing pad, implanting a plurality of linear elastic members which have abrasive tip ends into the circumferential surface of the supporting section, abrading and roughening of the surface of the polishing pad using a plurality of linear elastic members which elastically deform in a manner that enables the tip ends to follow different heights of the polishing pad caused by surface waviness thereof in order to uniformly perform conditioning over the surface of the polishing pad, rotating the supporting section by a predetermined angle at predetermined time intervals, partially exchanging a plurality of linear elastic members with old tip ends with a plurality of linear elastic members with new tip ends such that a linear elastic members with a combination of old and new tip ends are present, and performing the partial exchange of the old and new tip linear elastic members automatically during polishing of a work.

15. A conditioning method for dressing a surface of a polishing pad which is used in a polishing apparatus for polishing works, comprising the steps of:

providing a circular substrate having a circular substrate surface with a axis of rotation at a center of the circular substrate which is perpendicular to the circular substrate surface, and which has a plurality of linear elastic members which are implanted in the circular substrate surface so as to form a cup shaped therewith and which have abrasive tip pieces on free ends thereof;

rotating the circular substrate about said axis of rotation at predetermined time intervals with the circular substrate disposed at a predetermined oblique angle relative to the surface of the polishing pad in a manner enabling the tip pieces to follow different heights of the surface of the polishing pad caused by surface waviness in order to uniformly perform conditioning over the surface of the polishing pad when the tip ends are brought into contact with the surface of the polishing pad, abrading and roughening the surface of the polishing pads using the plurality of linear elastic members, partially exchanging a plurality of linear elastic members with old tip ends with a plurality of linear elastic members with new tip ends such that a linear elastic members with a combination of old and new tip ends are present, and performing the partial exchange of the old and new tip linear elastic members automatically during polishing of a work.

* * * * *